United States Patent [19]

Neyraud

[11] 3,981,253

[45] Sept. 21, 1976

[54] DEVICE FOR MAKING TUFT FABRIC

[75] Inventor: Rene Neyraud, Rhone, France

[73] Assignee: Verdol S.A., Caluire et Cuire, France

[22] Filed: Feb. 5, 1975

[21] Appl. No.: 547,151

[30] Foreign Application Priority Data

Feb. 14, 1974 France ..... 74.05651

[52] U.S. Cl. ..... 112/79 A

[51] Int. Cl.[2] ..... D05C 15/18

[58] Field of Search ..... 112/79 A, 79 R, 79 FF, 112/79.5, 78

[56] References Cited

UNITED STATES PATENTS

| | | | |
|---|---|---|---|
| 2,058,101 | 10/1936 | Perry | 112/79 A |
| 2,782,741 | 2/1957 | Smith | 112/79 A |
| 2,782,905 | 2/1957 | Smith | 112/79 A |
| 2,880,684 | 4/1959 | Masland | 112/79 A |
| 3,387,578 | 6/1968 | McCutchen | 112/79 A |

FOREIGN PATENTS OR APPLICATIONS

| | | | |
|---|---|---|---|
| 1,123,540 | 8/1968 | United Kingdom | 112/79 R |
| 853,943 | 11/1960 | United Kingdom | 112/79 A |

*Primary Examiner*—H. Hampton Hunter
*Attorney, Agent, or Firm*—Dowell & Dowell

[57] ABSTRACT

This device for making tuft figured fabric comprises, between the feed bobbin containing the tufting thread and the fabric to be tufted, a friction roller adapted to be shifted for engaging either of a plurality of cylinders driven at different speeds; said roller is mounted at one end of a rigid support having its opposite end responsive to a snap-action spring having an intermediate unstable position; the support is connected intermediate its ends to one end of a two-armed bell-crank lever fulcrumed at its apex to a fixed pivot pin and connected at its opposite end to another snap-action spring. Adjacent said snap-action springs each of said support and lever carries a stud engaging a vertically elongated aperture formed in a loop formed in a corresponding jacquard cord. Each friction roller has on its outer periphery an annular tire of resilient soft material formed with transverse grooves and adapted to engage the cylinder surfaces.

6 Claims, 5 Drawing Figures

DEVICE FOR MAKING TUFT FABRIC

The present invention relates to devices for making figured fabrics comprising a thread looped on itself, which are generally known under the term of "tuft".

A device of this kind comprises essentially means for controlling the feed rate of each thread or group of threads via a grooved pulley rigid with a friction roller, the said pulley and roller assembly being rotatably mounted on a movable support whereby the roller may be caused to engage either one of a pair of cylinders constantly driven at different speeds, each one of the various supports being controlled by one of the hooks of a jacquard.

In actual practice the supports of these pulley and friction roller assemblies generally consist of rocking levers, each lever being connected on the one hand with a fixed cross-beam via a return spring and on the other hand with the corresponding hook of the jacquard via a compensating spring. When the hook is at its lowermost position the return spring urges the roller for rolling engagement with one cylinder, the roller pressure depending on the reaction of the said return spring, and when the hook is raised, the compensating spring having a suitable force causes the lever to pivot whereby the roller engages the other cylinder against the force of the said return spring, the pressure exerted by the roller against the other cylinder being in this case equal to the reaction differential between the two springs.

The results obtained with this arrangement are particularly satisfactory, and the only inconvenience thereof is that the loops thus obtained can have only two different lengths.

The improvements constituting the present invention aim at avoiding this inconvenience and at permitting of weaving tuft fabrics wherein the loops may have up to four different lengths.

The device according to this invention is characterized in that each movable support is responsive to means adapted to cause the said support to be shifted transversely so that it may engage another pair of cylinders, whereby the corresponding thread can be subjected to four different tension values.

This transverse movement of each support is obtained by pivoting a bell-crank lever having one end connected with the said support while its other end is connected with cord attached on the one hand to the hook of the jacquard adapted to actuate the movable support and on the other hand to a suitable return spring.

A typical example of the manner in which the present invention may be embodied in actual practice is diagrammatically illustrated in the accompanying drawing, in which.

Figures 1, 5:
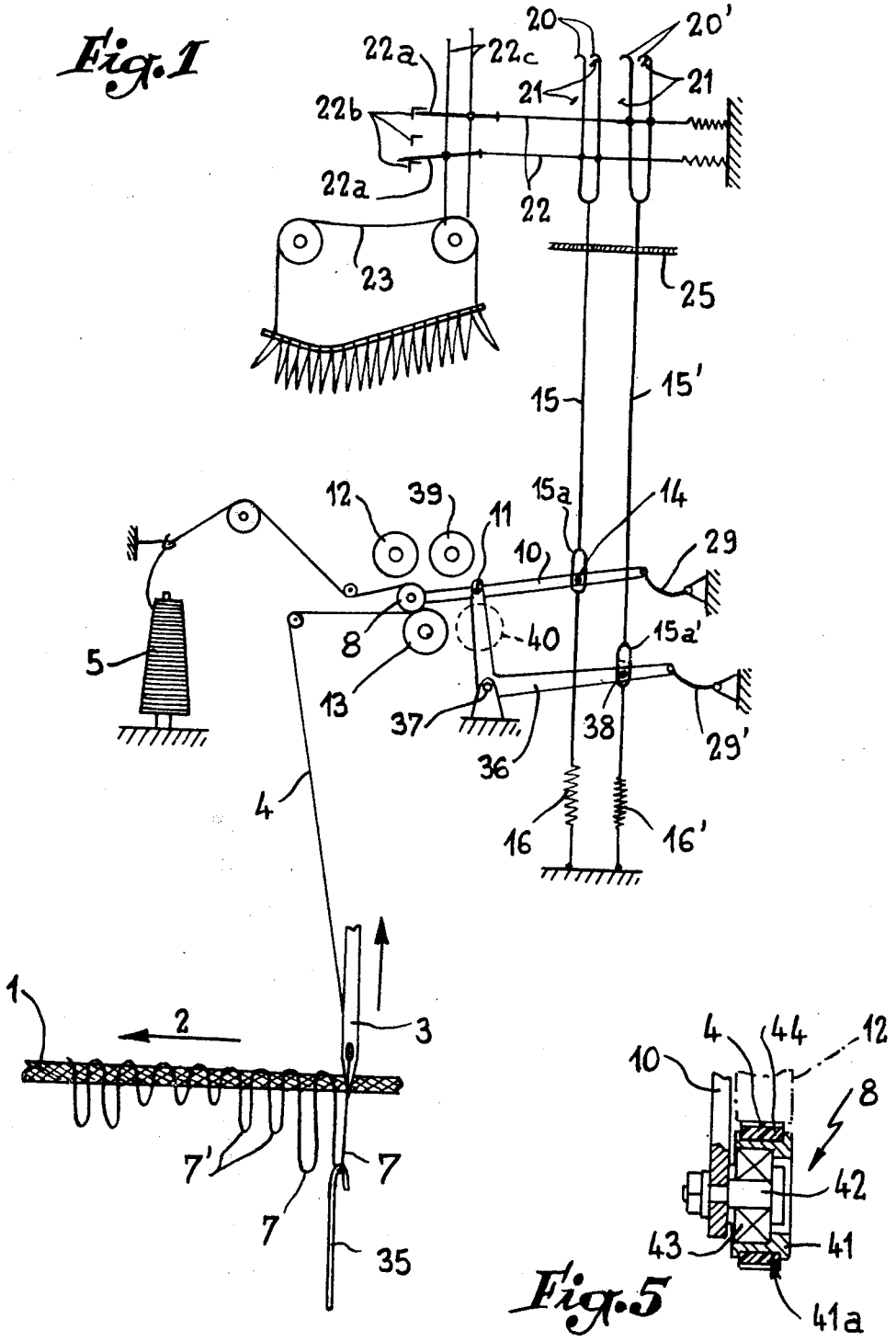
FIG. 1 is a diagrammatic side elevational view of a Verdol jacquard incorporating the improvements according to this invention.
FIG. 5 is a fragmentary section showing on a larger scale details of the friction roller.

The machine illustrated diagrammatically in FIG. 1 is adapted to form loops on one side of a relatively thick fabric 1. The manner in which these loops are formed will be briefly summarized hereinafter.

The fabric travels intermittently in the direction of the arrow 2 and the needle 3 is driven through the fabric each time the latter is stationary. The needle 3 receives from a spool or bobbin 5 a thread 4 passing through its needle eye. As the needle is driven through the fabric, it carries along the thread 4 to form a loop 7 underneath, as shown, and the loop is retained by a hook 35 during the upward stroke of the said needle 3. Then the fabric 1 is fed one step forwards and the hook 35 is disengaged from the previously formed loop, whereafter the needle 3 is again driven through the fabric to form the next loop. If the tension of thread 4 is moderate, the length of the loop thus formed is equal to the length of the preceding loop since the needle does not exert any tractive effort on the loop. In contact thereto, if a certain tension is applied to the thread 4 the next loop will consist partly of thread fed from the spool or bobbin 5 and partly of thread taken from the preceding loop, so that the resulting loop will have a reduced height. Under these conditions, the two successive loops thus formed will be substantially as shown at 7′ and 7, respectively.

Of course, the machine operating the needle 3 comprises a full row of such needles in order to form loops throughout the width of fabric 1.

The support or rocking lever 10 is connected at 14 with a cord 15 of a Verdol jacquard provided with vertically movable griffe frames, wherein each hook 20 is adapted to be moved horizontally by a needle 22 controlled by a pusher 22*a* adapted to be selectively driven by a grid 22*b* under the control of a feeler needle 22*c* selected in turn by a band of perforated paper 23. It will be noted that in order to avoid the presence of a spring liable to be more or less troublesome, the operative connection 14 is obtained by interposing on the cord 15 a vertically elongated loop 15*a* engaged by a pin (designated by the reference numeral 14) rigid with the lever 10 and leaving a sufficient freedom to this lever. The reference numeral 16 designates on the other hand the return spring associated with the said cord 15. The aforesaid lever 10 is pivotally connected at 11 to one end of a bell-crank lever 36 having its two arms disposed at 90° to each other and its apex pivoted by means of a pin 37 to a fixed bracket. The up and down movements of hook 20 and cord 15 determine a tilting displacement of lever 10, whereby the roller 8 supported thereby will alternately engage the cylinders 12 or 13 in order to impart two different tensions to the thread 4.

The end of lever 10 opposite to the end carrying the friction roller 8 is connected with a resilient blade 29 adapted to snap very rapidly through its position of unstable equilibrium.

Figure 2:
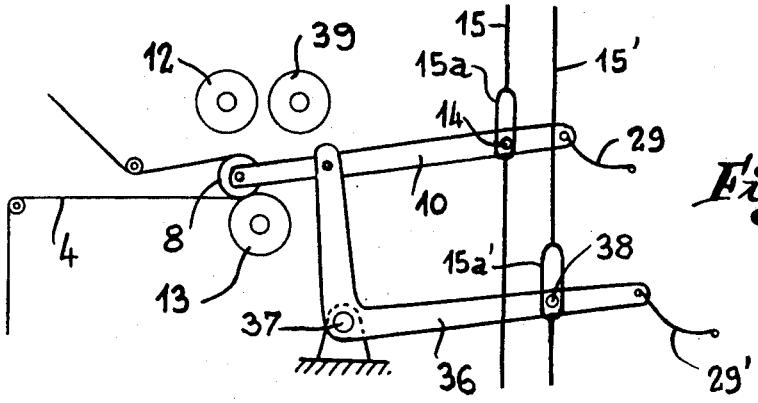
FIGS. 2 to 4 are diagrams illustrating the mode of operation of the device through its various positions.
Figure 3:
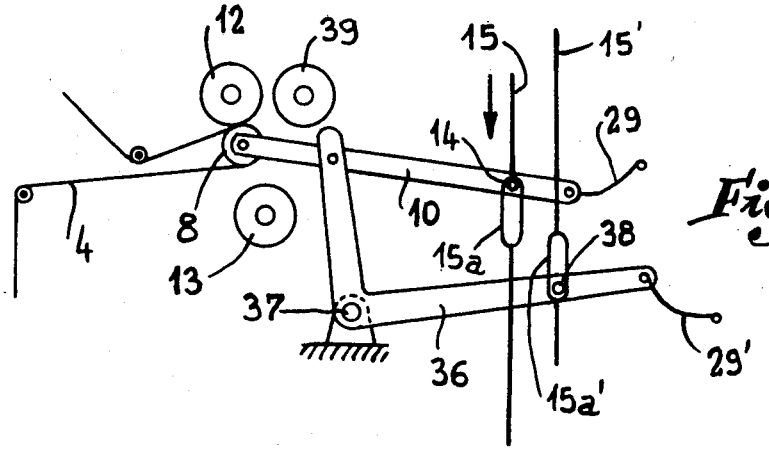

The other or opposite arm of the bell-crank lever 36 is connected on the one hand at 38 with another cord 15′ associated with a hook 20′ and on the other hand with a resilient blade 29′ having the same function as blade 29. In this case also a connecting loop 15*a*′ having an elongated vertical aperture is provided to impart to the said lever 36 a sufficient freedom to make it responsive to its blade 29′. The cord 15′ is urged downwards by a tension spring 16′. When the hook 20′ is at its upper position, i. e. when it cooperates with the frame 21, the lever 10 is so positioned that its roller 8 lies between cylinders 12 and 13, whereby it may engage either of them. As illustrated in FIG. 2, the roller 8 bears against cylinder 13 when hook 20 is at its uppermost position and against cylinder 12 when this hook 20 rests on the bottom board 25 (FIG. 3).

Figure 4:
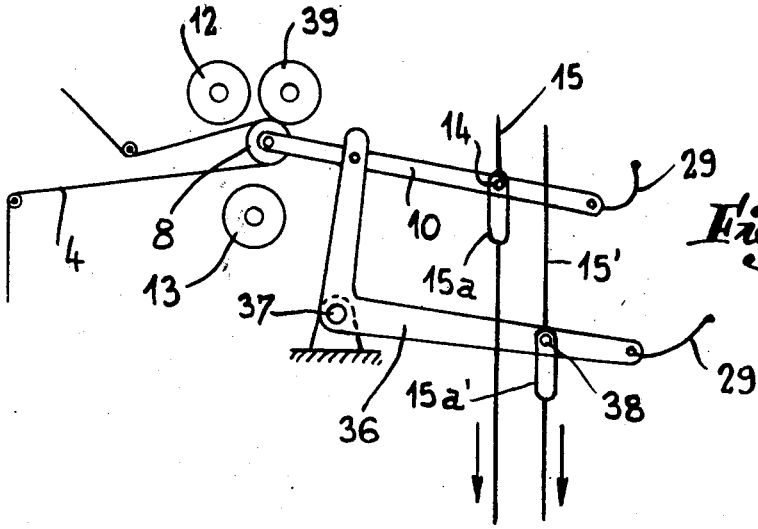

If the hook 20' comes to rest on this bottom board 25, the corresponding arm of the bell-crank lever 36 is lowered in order to actuate lever 10, whereby the corresponding roller 8 will engage a third cylinder 39 parallel to the previous ones 12 and 13. This cylinder 39 is driven at a different speed with respect to the other two cylinders 12 and 13, so that is this specific instance the roller 8 will impart a third tension to the thread 4 (see FIG. 4).

A fourth cylinder 40, shown in dash lines in FIG. 1, may be provided above this third cylinder 39; this fourth cylinder is adapted to be engaged by the said roller 8 when the hook 20' lies on the bottom board 25 and when the other hook 20 is at its upper position. Thus, a fourth thread tension value is obtained and consequently, if desired, loops having four different lengths may be formed during the weaving process. Of course, in this case the cylinder 13 is displaced to the left so that the said fourth cylinder 40 can be positioned ahead of the upstanding arm of bell-crank lever 36.

As illustrated in FIG. 5, the roller 8 comprises essentially an outer race 41 rotatably mounted about a shaft 42 rigid with lever 10, with the interposition of an anti-friction bearing 43, and the said race 41 has a groove 41*a* formed in its outer cylindrical surface and provided with a resilient tyre 44 of substantially annular configuration, made from a suitable material such as a natural or synthetic elastomer. Preferably, the outer peripheral surface of this tyre has transverse ribs or grooves formed therein to facilitate the passage of knots possibly formed in the thread 4 between one of the cylinders and the said tyre 44.

Preferably, the jacquard is of the double lift and open shed type so that the hooks can be kept at their upper position during several successive cycles.

Without any further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

I claim:

1. A device for feeding a thread at more than two different linear speeds in a tuft making machine, said device comprising:

a friction roller to frictionally advance said thread;

a first cylinder rotating at a first peripheral speed about its axis to frictionally drive said friction roller at a first angular speed so as to advance said thread at a first linear speed;

a second cylinder rotating at a second peripheral speed about its axis to frictionally drive said friction roller at a second angular speed so as to advance said thread at a second linear speed, the axis of said second cylinder being parallel to the axis of said first cylinder to define a plane therewith;

a first movable supporting member to rotatably support said friction roller;

a second movable supporting member to support said first supporting member;

first means to displace said first supporting member on said second supporting member in such a direction that for a first position of said second supporting member said friction roller may engage selectively said first and second cylinders to be driven by same at two different linear speeds;

second means to displace said second movable member between said first position and a second position more remote from said plane and for which said first means can no more bring said friction roller into engagement with said first and second cylinder;

and at least a third cylinder rotating at a third peripheral speed, the axis of said third cylinder being parallel to the axes of said first and second cylinder, and being so disposed laterally of said plane that for said second position of said second supporting member, said first means may bring said friction roller into engagement with said third cylinder to cause said roller to be driven at a third angular speed so as to advance said thread at a third linear speed.

2. In a device as claimed in claim 1:

said first, second and third cylinders being substantially horizontal, with said second cylinder being disposed below said first cylinder and with said third cylinder being situated laterally of said first and second cylinders, substantially at the same level as one of said first and second cylinders;

said first supporting member being pivoted to said second supporting member about a first pivot substantially parallel to the axes of said first, second and third cylinders, and spaced from said friction roller;

said second supporting means being pivoted about a fixed second pivot substantially parallel to said first pivot and spaced therefrom;

and said first and second means including respectively a first and a second cords of a Jacquard and a returning spring associated to each cord.

3. In a device as claimed in claim 2:

said first supporting member being in the form of a first lever carrying said friction roller at one of its end while said first cord of said Jacquard is attached to its other end, said first lever being pivoted to said second supporting member at a point intermediate its ends.

said second supporting member being in the form of a second lever of bell-crank shape having an upwardly directed arm to which said first lever is pivoted and a laterally directed arm to which said second cord of said Jacquard is attached.

4. In a device as claimed in claim 1, said friction roller having its periphery lined with a resilient material in which adjacent transverse grooves are formed.

5. A device as claimed in claim 1 further comprising a fourth cylinder rotating at a fourth peripheral speed, the axis of said fourth cylinder being parallel to the axis of said third cylinder, and said fourth cylinder being so disposed with respect to said third cylinder than when said second supporting means is at its second position, said first means may bring said friction roller into engagement with said fourth cylinder to cause said roller to be driven at a fourth angular speed so as to advance said thread at a fourth linear speed.

6. In a device as claimed in claim 5, said friction roller having its periphery lined with a resilient material in which adjacent transverse grooves are formed.

* * * * *